US008458847B2

(12) United States Patent
Herrmann et al.

(10) Patent No.: US 8,458,847 B2
(45) Date of Patent: Jun. 11, 2013

(54) CLEANING DEVICE AFFIXED TO A FOOTWEAR AND METHOD THEREOF

(76) Inventors: Brent Herrmann, Clifton Park, NY (US); Richard J. Herrmann, Jr., Clifton Park, NY (US)

( * ) Notice: Subject to any disclaimer, the term of this patent is extended or adjusted under 35 U.S.C. 154(b) by 595 days.

(21) Appl. No.: 12/635,773

(22) Filed: Dec. 11, 2009

(65) Prior Publication Data

US 2011/0138557 A1 Jun. 16, 2011

(51) Int. Cl.
*A46B 15/00* (2006.01)
*A43C 19/00* (2006.01)
*A63B 57/00* (2006.01)

(52) U.S. Cl.
USPC ..... 15/160; 15/176.1; 15/227; 36/127; 36/132; 36/136

(58) Field of Classification Search
USPC 15/160, 176.1–176.6, 202, 227, 246; 36/114, 36/127, 132, 136
See application file for complete search history.

(56) References Cited

U.S. PATENT DOCUMENTS

| | | | | |
|---|---|---|---|---|
| 3,751,832 | A * | 8/1973 | Baryluk | 36/117.1 |
| 3,811,207 | A * | 5/1974 | Peis | 36/117.1 |
| 4,122,577 | A * | 10/1978 | Catania | 15/160 |
| 5,809,669 | A * | 9/1998 | Hage et al. | 36/127 |
| 5,930,920 | A * | 8/1999 | Arnold | 36/132 |
| 5,979,008 | A * | 11/1999 | Gordon | 15/227 |
| 6,092,313 | A * | 7/2000 | Dunlap et al. | 36/132 |
| 6,128,801 | A * | 10/2000 | Adzick et al. | 15/210.1 |
| 6,393,648 | B1 * | 5/2002 | Reynolds | 15/160 |
| 7,313,842 | B1 * | 1/2008 | Preciado | 15/227 |
| 2003/0131500 | A1 * | 7/2003 | Kline et al. | 36/127 |
| 2003/0208868 | A1 * | 11/2003 | Thompson | 15/160 |
| 2003/0208869 | A1 * | 11/2003 | Thompson | 15/160 |
| 2003/0208932 | A1 * | 11/2003 | Thompson | 36/127 |
| 2006/0283049 | A1 * | 12/2006 | Huseby | 36/127 |
| 2009/0293215 | A1 * | 12/2009 | Zhou | 15/210.1 |
| 2011/0030159 | A1 * | 2/2011 | Mullis | 15/160 |

FOREIGN PATENT DOCUMENTS

| | | | |
|---|---|---|---|
| JP | 11-151332 | * | 6/1999 |
| WO | 96/09779 | * | 4/1996 |

* cited by examiner

*Primary Examiner* — Mark Spisich
(74) *Attorney, Agent, or Firm* — Schmeiser, Olsen & Watts, LLP

(57) ABSTRACT

A device comprising a cleaning device operably attached to a mounting device, wherein the mounting device is configured to engage a footwear, wherein the cleaning device facilitates the cleaning of equipment, such as a golf club. Furthermore, a method of cleaning a golf club comprising providing a cleaning device, wherein the cleaning device has a first end and a second end, coupling the first end of the cleaning device and the attachment device, wherein the attachment device and a mounting plate form a mounting device, and wherein the mounting device is configured to engage a footwear is also provided.

11 Claims, 9 Drawing Sheets

CLEANING DEVICE AFFIXED TO A FOOTWEAR AND METHOD THEREOF

BACKGROUND OF THE INVENTION

1. Field of the Invention

The present invention relates to an apparatus and method of mounting a cleaning device, in particular, a golf club cleaning brush, onto a piece of footwear.

2. Related Art

As recreational sports, such as golf, become increasingly popular, the more crowded golf courses may become. Therefore, to allow as many participants as possible to play a round of golf in a given day, a certain pace of play must be maintained, or sometimes increased depending on the volume of participants on the golf course. One aspect of the game that may slow the pace of play is the need to have a clean club face, free from course debris. Each time a player takes a practice swing, uses, or sets down a club, the club face may need to be cleaned. Unfortunately, a golf club cleaner may not always be at arm's length to clean the club. Rules and etiquette of the game may not allow a participant to retrieve a golf club cleaner from a distant golf club bag or golf cart. Typically, the participant must either break the rules by returning to the golf cart to use a brush, which halts play and decreases the pace of play, or attempt a golf shot with a dirty, debris-covered golf club, which usually negatively alters the accuracy, contact, and trajectory of the golf ball.

Thus, there is a need for a device and method which overcomes the aforementioned deficiencies in the art for affixing a cleaning device, in particular, a golf club cleaning brush, proximate a piece of footwear.

SUMMARY OF THE INVENTION

A first aspect of the present invention provides a device comprising a cleaning device operably attached to a mounting device, wherein the mounting device is configured to engage a footwear, wherein the cleaning device facilitates the cleaning of equipment.

A second aspect of the present invention provides a golf club cleaning device comprising a mounting plated coupling a footwear, the mounting plate having at least one opening therethrough, an attachment device on the mounting plate, the attachment device being receptive to a first end of a cleaning device to releasably secure the cleaning device to the mounting plate, wherein a first surface of the attachment device corresponds to a mating surface of the first end of the cleaning device and a second end of a cleaning device configured to contact a golf club, the second end protruding from the footwear.

A third aspect of the present invention provides A method of cleaning a golf club comprising providing a cleaning device, wherein the cleaning device has a first end and a second end, coupling the first end of the cleaning device and the attachment device, wherein the attachment device and a mounting plate form a mounting device, and wherein the mounting device is configured to engage a footwear.

The foregoing and other features of construction and operation of the invention will be more readily understood and fully appreciated from the following detailed disclosure, taken in conjunction with accompanying drawings.

BRIEF DESCRIPTION OF THE DRAWINGS

Some of the embodiments of this invention will be described in detail, with reference to the following figures, wherein like designations denote like members wherein.

DETAILED DESCRIPTION OF THE DRAWINGS

Although certain embodiments of the present invention are shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of embodiments of the present invention.

As a preface to the detailed description, it should be noted that, as used in this specification and the appended claims, the singular forms "a", "an" and "the" include plural referents, unless the context clearly dictates otherwise.

Figure 1:
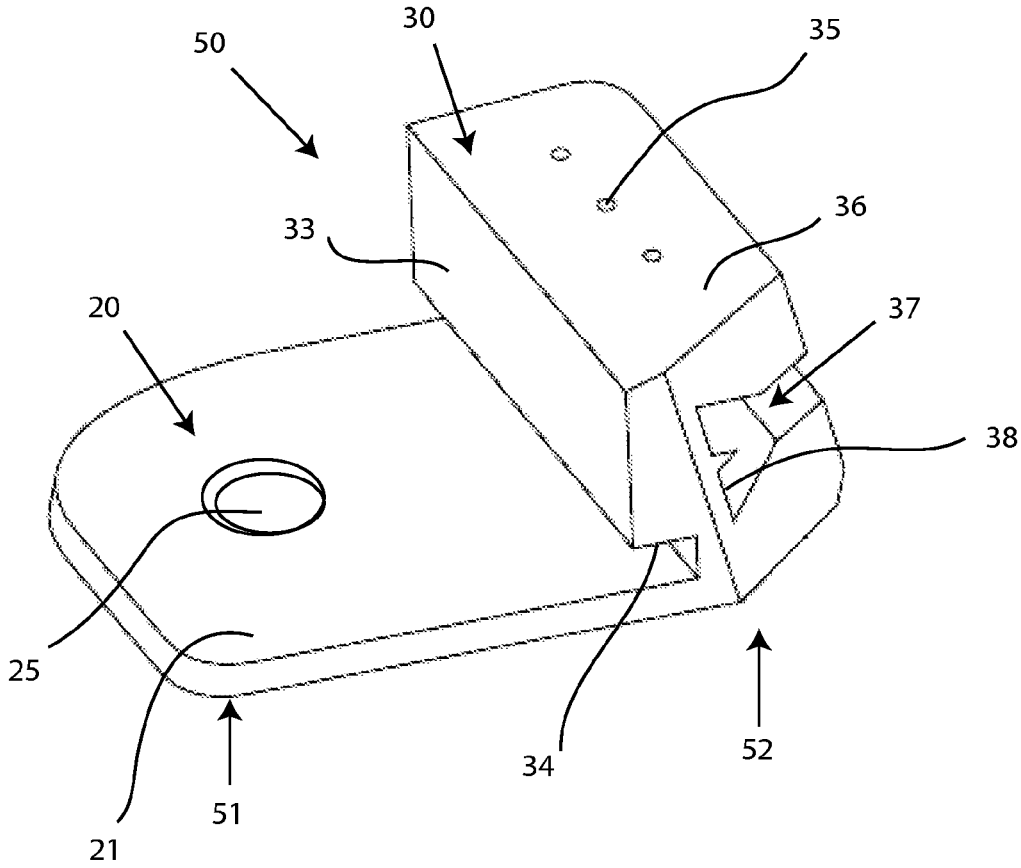
FIG. 1 depicts a perspective, partially cut-away view of an embodiment of a mounting device, in accordance with the present invention.

Referring now to the drawings, FIG. 1 depicts an embodiment of a mounting device 50. A mounting device may have, inter alia, a first end 51, a second end 52, a mounting plate 20, an attachment device 30 proximate the second end 52, at least one opening 35 located on the attachment device 30, and at least one opening 25 located on the mounting plate 20. The mounting device 50 may also be a brace, rack, unit, member, support, bracket, clamp, or any device that facilitates the engagement of a footwear 90, which is also capable of accepting a and supporting a cleaning device 40. The mounting device 50 may include a mounting plate 20 and an attachment device 30, which may form the mounting device 50 configured to engage a footwear 90. In one embodiment, the mounting device 50 may be one, solid, uniform, consistent member, piece, structure, component, etc., wherein the mounting plate 20 forms, or represents, a part, or portion, of the mounting device 50, and the attachment device 30 also forms, or represents, a part, or portion, of the mounting device 50. The mounting device 50 may also be hollowed out, or may be constructed by injection molding, or other various means of fabrication. In another embodiment, the mounting device 50 may be formed by two separate parts, for example, the attachment device 30 may be attached, affixed, glued, bonded, connected, screwed, bolted, welded, etc., to the mounting plate 20. The shape of the mounting device 50 may vary, but in many embodiments, may be curvilinear, or circular, to conform to most designs of footwear 90. For example, a typical footwear 90 may be curvilinear around the toes, or front of the footwear 90. Therefore, the mounting device 50 may be shaped, generally, to conform to the shape of the footwear 90, and in many embodiments, may be rounded, or curvilinear.

Figure 2A:
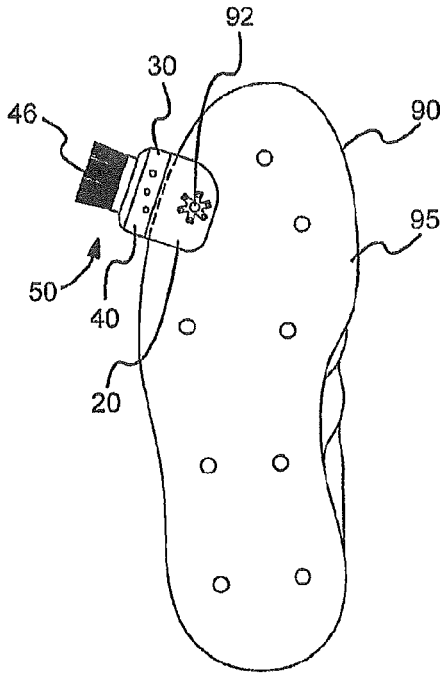
FIG. 2A depicts a bottom view of an embodiment of a mounting device engaging a footwear, in accordance with the present invention.
Figure 2B:
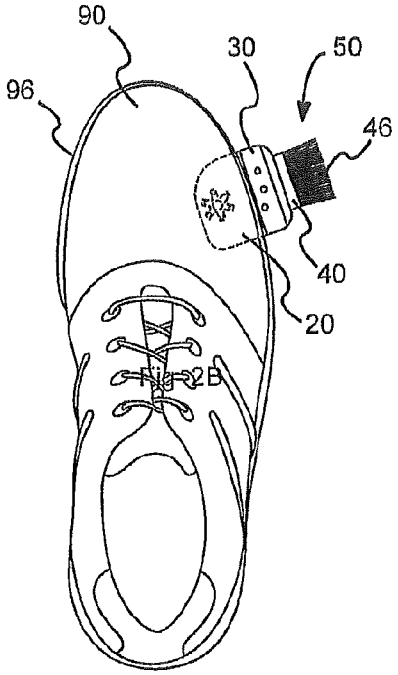
FIG. 2B depicts a top view of an embodiment of a mounting device engaging a footwear, in accordance with the present invention.
Figure 2C:
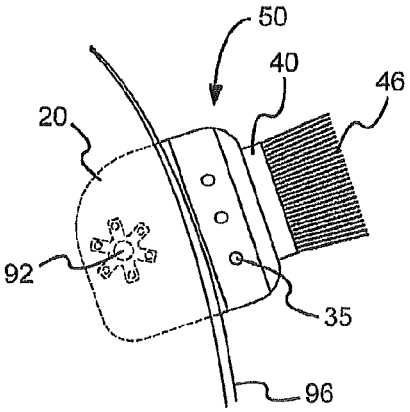
FIG. 2C depicts a top view of an embodiment of a mounting device positioned alongside a footwear, wherein the footwear is hidden, in accordance with the present invention.
Figure 3:
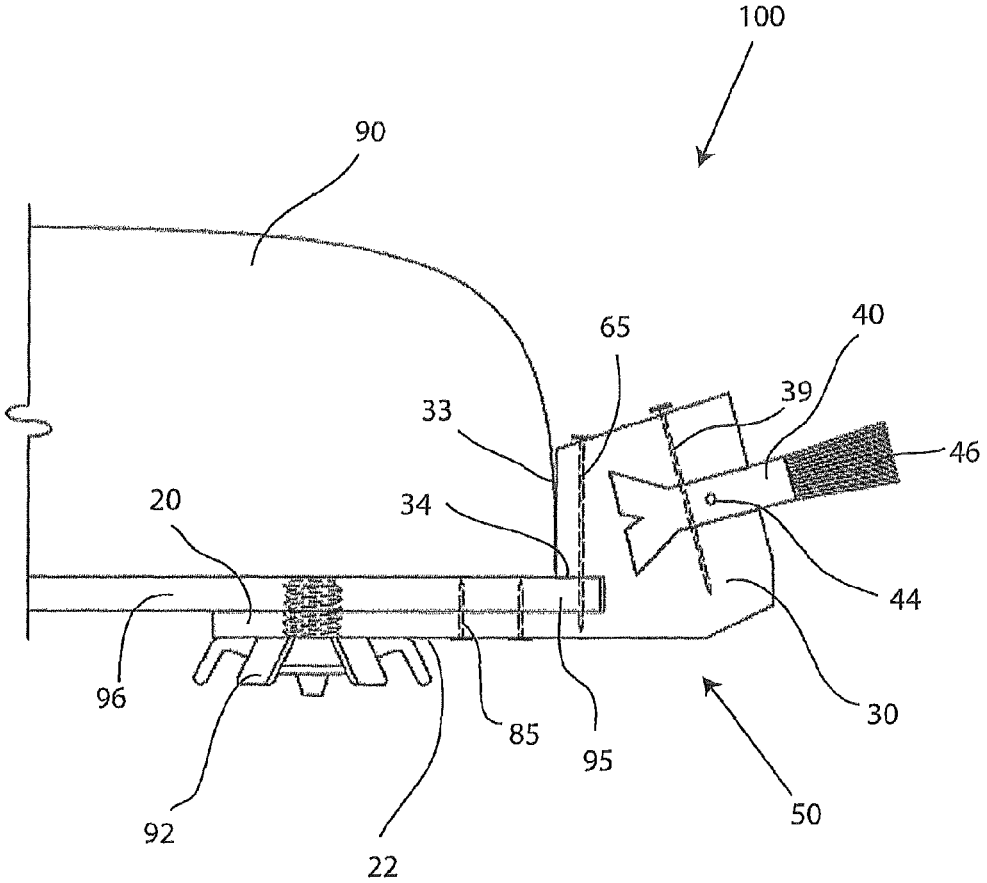
FIG. 3 depicts a side view of an embodiment of a mounting device engaging a footwear, in accordance with the present invention.
Figure 10:
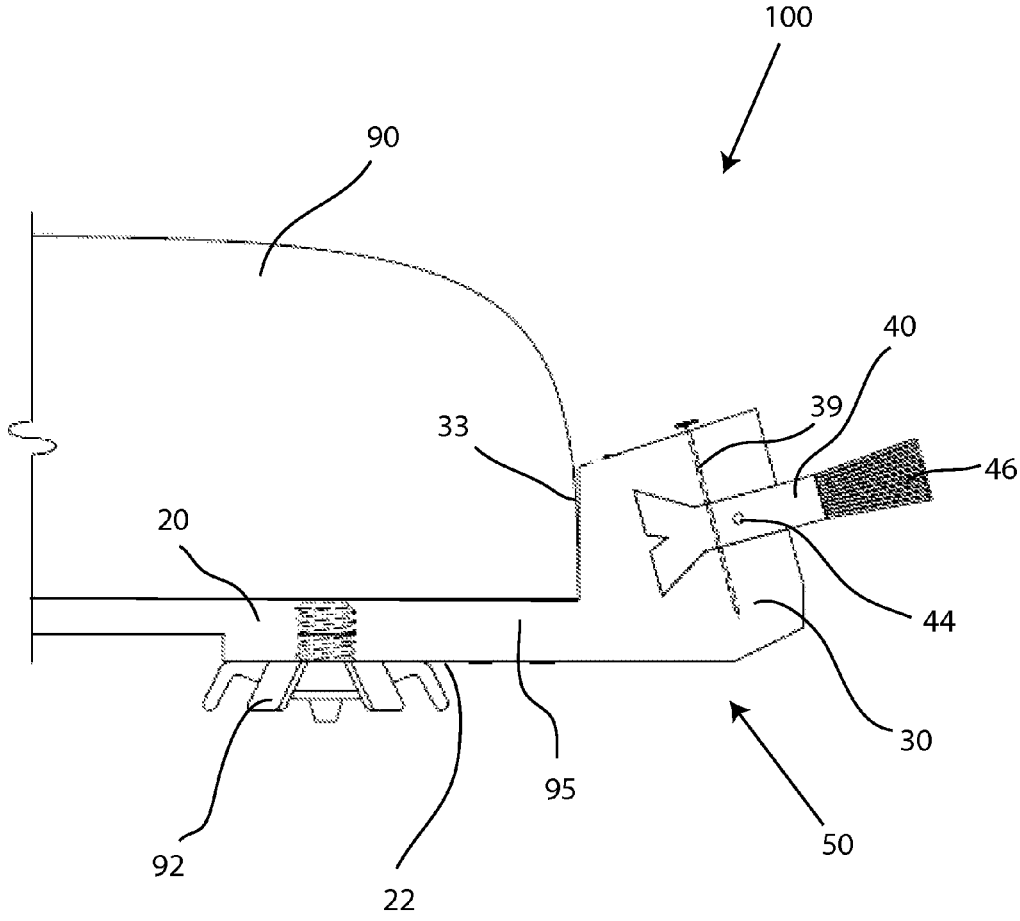
FIG. 10 depicts a side view of an embodiment of the mounting device molded as part of a sole of a footwear.

Referring now to FIGS. 2A-2C, the mounting device 50 may be configured to engage a piece of footwear 90. Moreover, the mounting device 50 may directly contact, contact, bond, connect, mount, etc., a footwear 90. The mounting device 50 may also be capable of engaging a footwear 90, may be positioned alongside a footwear 90, and/or may be shaped, constructed, designed, adapted, patterned, and/or shaped to engage, mount, bond, connect, rest against, directly contact, grip, couple, etc., with a footwear 90 or a portion of a footwear 90. For instance, the mounting device 50 may be affixed, attached, glued, bonded, nailed, fastened, molded, or coupled to a piece of footwear 90 through various means described herein or otherwise known to those skilled in the art. In one embodiment, the mounting device 50 may be coupled, or adhered, to a footwear 90 by any adhesive, specifically, by a thin, adhesive layer 26, or film, placed on a top surface 21 of the mounting plate 20. The adhesive layer 26 may come with a non-adhesive cover 27 that may be peeled away to reveal the adhesive layer 26. In another embodiment, glue, epoxy, rubber cement, or any other adhesive may be applied to the mounting device 50 immediately prior to attachment to a footwear 90. In another embodiment, the mounting device 50 may be fastened to the footwear 90 by at least one small fastener 85, as shown in FIG. 3. The small fasteners 85 may be any fastening device, such as a nail or screw, and described as small only for the purpose and understanding that the length of the small fasteners 85 may be smaller than other fasteners used throughout the device 100. The small fasteners 85 may be made of metal, composites, wood, or hard plastic; however, if the small fasteners 85 should be constructed of metal, they must not be exposed a distance below the footwear 90 to cause any damage to any surface, such as a green or fairway of a golf course, any interior surface, for example, in a clubhouse. Additionally, the small fasteners 85 may be driven through the mounting plate 20, starting from the bottom surface 22 through the top surface 21 to secure the mounting device 50 to an underside of the footwear, or the sole 95 of the footwear 90. Moreover, the length of the small fasteners 85 should be a length such that after engaging the sole 95, they do not extend completely through the sole 95 and into the interior of the footwear to avoid injury to a foot, and should not extend a distance below the bottom surface 22 of the mounting plate 20 such that they contact the ground or potentially expose sharp edges. In another embodiment, the mounting device 50 may be both adhered to the sole 95 of the footwear 90 and secured by at least one small fastener 85. FIG. 10 depicts yet another embodiment, wherein the mounting device 50 may be molded into or incorporated into the footwear 90 when the footwear 90 is made. This method of manufacture may provide stability and support to the device 100, and allow a manufacture to match colors, dyes, and spike 92 locations at the same point in the manufacturing process.

The mounting device 50 may engage a footwear 90, or a portion of a footwear 90, wherein a footwear 90 may include any style of footwear 90, and may be a single shoe. For example, footwear 90 may include a low-top, high-top, a tennis shoe, a golf shoe, a running shoe, a work boot, a combat boot, an open toed shoe, such as a sandal, and any piece of footwear 90 that includes a sole 95, or a substantial portion of a sole 95. The mounting device 50, including the mounting plate 20 and the attachment device 30, may best engage, affix to, attach to, couple with, etc., a footwear that is raised a distance above the ground surface to allow the mounting device 50, in particular, the mounting plate 20 to fit underneath the sole 95 without impacting the landing of the footwear 90. For example, a footwear 90 having spikes, such as a golf shoe, may raise the sole 95 of a footwear 90 a distance above the ground to sufficiently allow the mounting plate 20 to fit underneath the sole 95. Any footwear 90 having a space between the sole 95 and the ground surface may best accommodate the mounting device 50.

Referring back to FIG. 1, mounting plate 20 may be configured to engage a footwear 90, in particular, an underside or sole 95 of a footwear. Moreover, the mounting plate 20 may directly contact, contact, bond, connect, mount, etc., a footwear 90. The mounting plate 20 may also be capable of engaging a footwear 90, may be positioned alongside a footwear 90, and/or may be shaped, constructed, designed, adapted, patterned, and/or shaped to engage, mount, bond, connect, rest against, directly contact, grip, couple, etc., with a footwear 90 or a portion of a footwear 90. For instance, the mounting plate 20 may be affixed, attached, glued, bonded, nailed, fastened, molded, or coupled to a piece of footwear 90 through various means described herein or otherwise known to those skilled in the art. Moreover, the mounting plate 20 may also be a flat portion, a disc, a slab, a stratum, a planar member, or any substantially flat member capable of fitting substantially flat against a sole 95 of a footwear 90. The mounting plate may have at least one opening 25 located on its surface, the at least one opening 25 extending the entire height of the mounting plate 20, from the top surface 21 to the bottom surface 22. The openings 25 may allow a spike 92, such as a golf spike, to pass through the mounting plate 20. For instance, before adhering, fastening, coupling, attaching, or engaging a footwear 90, any spike 92 located on the sole 95 may be removed from the footwear 90. After the mounting plate 20 is secured to a sole 95, the spikes 92 may be reattached through the openings 25 located on the mounting plate 20. Those in the art will appreciate that the location of the openings 25 may correspond to the locations of the spikes 92 on the sole 95, and their respective spike cavities, such that the openings 25 will allow access to replace the spike 92 onto the footwear 90. Moreover, the location of the openings 25 may be predetermined to fit a particular design, make, or model footwear.

Figure 4:
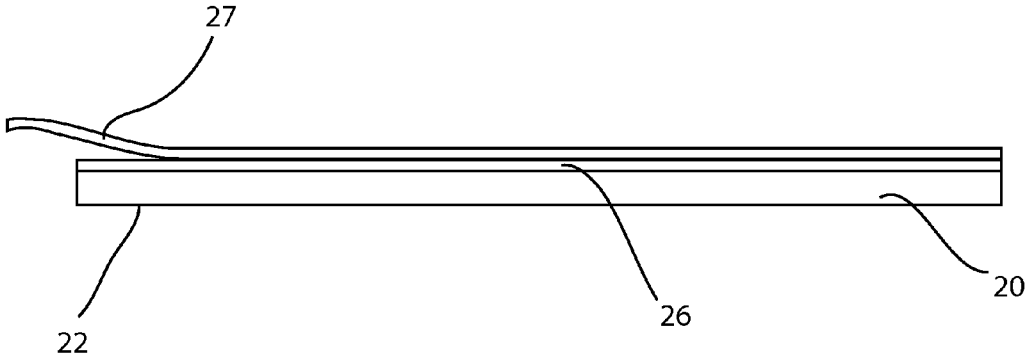
FIG. 4 depicts a side, cross-section view of an embodiment of a mounting plat having an adhesive layer and a non-adhesive cover, in accordance with the present invention.

Additionally, the mounting plate 20 may have a thin film, or adhesive layer 26 spread across the top surface 21, or spread substantially across the sop surface 21 to bond, adhere, secure, couple, etc., the top surface 21 of the mounting plate 20 to a portion of the sole 95, or footwear 90, as shown in FIG. 4. In many embodiments, a non-adhesive cover 27 may be placed over the adhesive layer 26 to avoid unintentionally bonding and/or convenience during packaging, transport, handling, etc. When the mounting plate 20 is ready to be secured to a portion of the sole 95 of the footwear 90, the non-adhesive cover 27 may be peeled back and removed, exposing the adhesive layer 26. The openings 25 should first be aligned with the spike cavities, and then the mounting plate 20 may be pressed onto a portion of the sole 95 of the footwear 90 to secure, bond, adhere, etc., it to the footwear 90. After the mounting plate 20 is attached to the sole 95, the spikes 92 may fit through the openings 25 and may be replaced. The replacement of the spikes 92 may assist and/or facilitate the fastening of the mounting device 20 to the footwear 90. Furthermore, when attaching the mounting plate 20 to the sole 95, it may be placed proximate to the edge of the footwear 90, wherein the mounting plate 20 being located underneath the footwear 90, and the attachment device 30 being located on the side of the footwear 90, as shown in FIGS. 2A-2C In other words, the attachment device 30 may be located on the side of footwear 90, such that it rests against an outer surface 96 of the sole 95, and may be accessible without removing the footwear 90.

Alternatively, the mounting plate 20 need not have an adhesive layer 26, nor be bonded or adhered by an adhesive to secure it to the sole 95 of a footwear 90. The mounting plate 20 may also be secured to the sole 95 of footwear 90 using at least one small fastener 85, at least one large fastener 65, or a combination thereof. However, the placement and location of the mounting plate 20 underneath the footwear 90 may be the same as if adhering it using the adhesive layer 26, except one or more small or large fasteners, 85, 65 may be driven through the mounting plate 20 to engage the sole 95 of the footwear 90. In one embodiment, the large fastener 65 may be driven through the top of the device 100. In another embodiment, the large fastener 65 may be driven from the front of the device proximate the cleaning device 40. When securing the mounting plate 20 to the footwear 90, the fasteners 65, 85 may have a length such that they do not extend through the sole 95 and extend into the interior of the footwear 90, which may cause injury to a foot inside the footwear 90. Furthermore, the mounting plate 20 may be both adhered, bonded, etc., to the sole 95 using the adhesive layer 26 and secured to the sole 95 by using at least one small or large fastener 85, 65. In both of these embodiments, the mounting plate 20 may be removable from the footwear 90. For example, the mounting plate 20 may be peeled off the sole 95 and/or fasteners 65, 85 removed, and be re-attached using one or more small or large fasteners 85, 65 or additional adhesives. However, the mounting plate 20 may be molded into or incorporated into the footwear as a portion, or part, of the sole 95 when the footwear 90 is made. This method of manufacture may provide stability and support to the device 100, and allow a manufacture to match colors, dyes, and spike 92 locations at the same point in the manufacturing process. Being molded or incorporated into the footwear 90 may prevent the mounting plate and/or mounting device 50 from being removable.

The mounting plate 20 may be curvilinear in shape, such as a circle. In many embodiments, the mounting plate 20 may be shaped to correspond to the curvature of the sole 95. Moreover, the mounting plate 20 is configured to engage only a portion of the sole 95 of the footwear 90. Because the mounting plate 20 is configured to engage only a portion of the sole 95, the shape of the mounting plate 20 may vary. For instance, the end of the mounting plate 20 proximate the attachment device 30, or proximate the second end 52 of the mounting device 50, may be curvilinear and correspond to the curvature of the sole 95. However, the end of the mounting plate 20 distal to the attachment device 30, or proximate the first end 51 of the mounting device 50, may also be curvilinear, but may also be any desirable shape, such as rectangular, polygonal, and the like. In one embodiment, the end of the mounting plate 20 distal to the attachment device 30, or proximate the first end 51 of the mounting device 50, may be designed to appropriately and efficiently conform to the design and/or model of the particular footwear 90. The mounting plate 20 may be reversible, wherein the mounting plate 20 may be placed on either the left oriented footwear 90 or the right oriented footwear 90. For example, a mounting plate may be attached to a left golf shoe and between holes, may be removed and attached to a right golf shoe without any alterations needed. Furthermore, the mounting plate 20 may be constructed out of material that is resilient, flexible, semi-rigid, and the like, to conform to the sole 95, as well as to remain lightweight. However, the mounting plate 20 may also be constructed out of a rigid material. Therefore, the mounting plate 20 may be constructed out of, inter alia, metal, composites, hard plastic, rubber, nylon, vinyl, combination thereof, or any other suitable material commonly used in footwear.

Referring again to FIG. 1, an attachment device 30 may be located proximate the second end 52 of the mounting device, the attachment device 30 being receptive to a first end 41, or base member 43, of a cleaning device 40 to releasably secure the cleaning device 40 to the mounting plate 20, wherein a groove surface 38, or first surface, of the attachment device 30 corresponds to a mating surface 48 of the first end 41 of the cleaning device 40. The attachment device 30 may also be a groove, a receptor, a clip-in device, a slide-in device, or any device capable of receiving a cleaning device 40 and removably securing it to the mounting plate 20. The attachment device 30 may be a component of the mounting plate 20 and/or it may be a component of the mounting device 50. For example, the attachment device 30 and the mounting plate 20 together may form, or represent, the mounting device 50. In another example, the attachment device 30 may be a portion or component of the mounting plate 20. In many embodiments, the attachment device 30 and the mounting plate 20 are comprised of the same material, which may be a flexible, resilient, semi-rigid, or rigid material such as, inter alia, metal, composite, hard plastic, rubber, vinyl, nylon, a combination thereof, or any other suitable material commonly used in footwear.

Furthermore, the attachment device 30 may include a back surface 33, a flange 34, a top surface 36, at least one opening 35 located on the top surface 36, and a groove 37 running horizontally therethrough. The back surface 33 may contact a side of the footwear 90 when the mounting device 50 is affixed to the footwear 90. Located adjacent to the back surface 33 may be a top surface 36, wherein at least one opening 35 may be located. The top surface 36 may be pitched, or sloped, to facilitate the angling of the cleaning device 40. Moreover, the top surface 36 may be angled to allow the cleaning device 40 to be upwardly angled from a ground surface. The openings 35 located on the top surface 36 may accept, receive, accommodate, etc., at least one locking pin 39, and may be horizontally aligned across the top surface 36 of the attachment device 30. One or more locking pins 39 may be inserted into the openings 35 to removably secure the cleaning device 40 into its place within groove 37. For instance, the cleaning device 40 may have one or more openings, or detents, 45 located thereon, wherein the cleaning device openings 45 are aligned with the attachment device openings 35, and accommodate, accept, receive, etc., the at least one locking pin 39 which may be inserted to secure the cleaning device 40. The locking pin 39 may or may not be needed or required to removably secure the cleaning device 40, and the decision whether to utilize a locking pin 39 may depend on the friction coefficient of the materials used to manufacture the components. For example, a locking pin 39 may be useful if the cleaning device 40 may be likely to slide loose from groove 37. The locking pin 39 may be any tubular object, such as a pin, needle, screw, bolt, nail, and the like. In one embodiment, more than one locking pin 39 may be coextensively connected together by a horizontal member, forming a "pitchfork" to lock the cleaning device 40 into place within the groove 37 in more than one of the openings 35.

Located adjacent to the back surface 33 and distal to the top surface 36 may be a flange 34. Flange 34 may create a space, channel, opening, or a place where the sole 95 may fit into when the mounting device 50 is affixed to the footwear, as shown in FIG. 3. This may allow the mounting device 50 to fit against the footwear 90 as snugly as possible to help support the cleaning device 40 and help prevent any undue deflection of the mounting plate 20. Running horizontally through the attachment device 30 may be a groove 37 having a groove surface 38, or first surface, which may correspond with a mating surface 48 of a first end 41, or base member 43, of the cleaning device 40. The groove 37 may be an opening, a channel, a gap, a cavity, a keyway, and the like. The groove 37 may have various cross-sections, including, but not limited to, rectangular, trapezoidal, dovetail, circular, polygonal, hexagonal, pentagonal, square, and the like. The profile created by the groove surface 38 may define the cross-section, and may correspond to the profile of the mating surface 48 of the cleaning device 40. Furthermore, the shape, structure, frame, mold, contour, profile, surface, construction, or figure of the attachment device 30, in particular, the groove 37, may correspond to the shape, structure, frame, mold, contour, profile, surface, construction, or figure of the first end 41, and/or base member 43, of the cleaning device 40. Thus, the attachment device 30, and/or groove 37, may accept, accommodate, receive, mate, interlock, couple, house, engage, secure, interlock, and/or accept the cleaning device 30.

Figure 5:
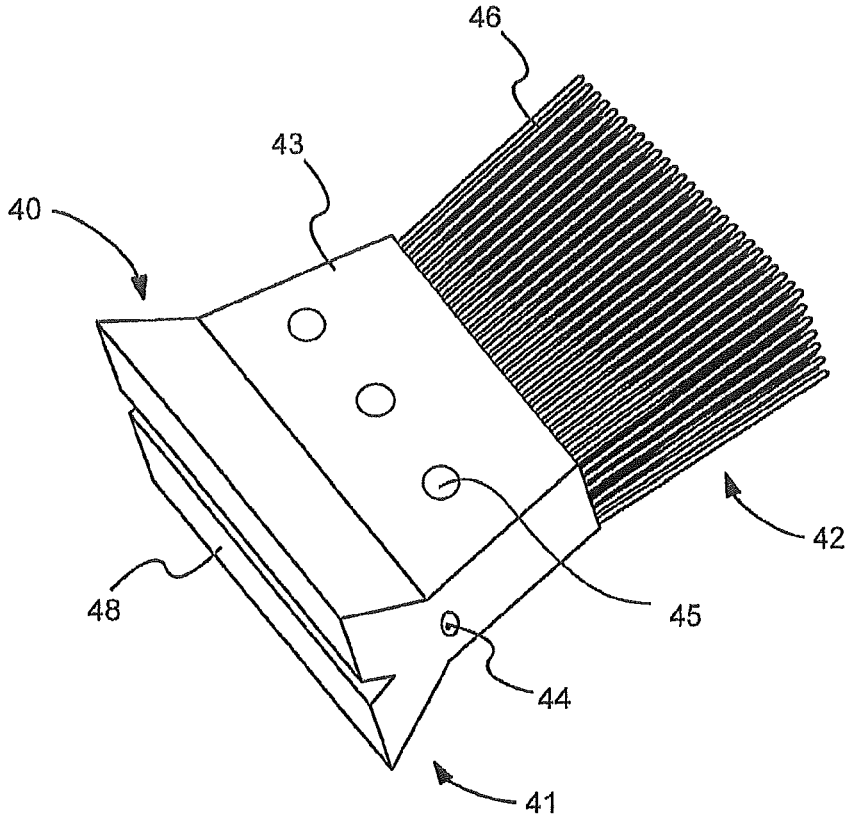
FIG. 5 depicts a perspective view of an embodiment of a cleaning device, in accordance with the present invention.

Referring now to FIG. 5, a cleaning device 40 may be operably attached to a mounting device 50. Additionally, the cleaning device 40 may be operably attached to the attachment device 30. The cleaning device 40 may have a first end 41, a second end 42, a dimple 44 located thereon, a base member 43 proximate the first end 41, and a brush portion 46 proximate the second end 42, wherein the brush portion 46 may be attached to the base member 43. The cleaning device 40 may angularly protrude from a footwear 90. In one embodiment, the cleaning device 40 may angularly protrude away from the footwear 90 at an angle between 0° to ° 70 with respect to a ground surface Proximate the first end 41, the cleaning device 40 may have a mating surface 48 that may correspond to the groove surface 38 of the attachment device 30, such that the mating surface 48 of the cleaning device 40 may mate, interlock, communicate, contact, and/or couple with the groove surface 38 to removably secure the cleaning device 30 to the attachment device 30 within the groove 37. For instance, the base member 43 may have a mating surface 48 that corresponds with the groove surface 38, and the base member 43 may be dimensioned such that it fits within the groove 37 to removably secure the cleaning device 30 into the attachment device 30. The cleaning device 40 should be secured strongly enough and/or fit snugly enough that the cleaning device 40 may sustain any resistance or applied mechanical forces from the cleaning a piece of sport equipment, such as a golf club, and not unintentionally become dislodged. Furthermore, the base member 43 may have various cross-sections, including, but not limited to, rectangular, trapezoidal, dovetail, circular, polygonal, hexagonal, pentagonal, square, and the like. The profile of the mating surface 48 may define the cross-section, and may correspond to the profile of the groove surface 38 of the attachment device 30.

Moreover, the cleaning device may have a brush portion 46 attached, affixed, bonded, etc., to the base member 43. For example, the brush portion 46 may be attached to the attachment device 30 by thermal molding, injection molding, an adhesive, plug ports, or any other method of securing brush-like components to another structure. The combination of the brush portion 46 and the base member 43 may comprise, generally, the cleaning device 40. The brush portion 46 may be made of interlocked bristles, wire bristles, wire mesh, copper mesh, steel mesh, brass mesh, steel bristles, brass bristles, horse hair, synthetic, nylon, similar brush materials, and any other brush/cleaning materials that may facilitate the removal of dirt, golf course debris, mud, grass, and the like. Alternatively, the brush portion 46 may comprise a layer of sandpaper, sandpaper having various grit sizes, a plurality of beads, said beads being rubber, composites, hard plastic, metal, or any suitable material. The brush portion 46 may protrude or extend a distance from the base member 43. In many embodiment, the brush portion 46 may protrude or extend anywhere from 0.1 to 5 centimeters (0.01 to 2 inches). Those in the art should appreciate that the length of the brush portion 46 may vary, and may be any length outside 0.1 to 5 cm. However, the brush portion 46 may be long enough to clean a piece of sports equipment, such as a golf club face, but may also be short enough to remain unobtrusive to lessen the possibility of snagging clothes or debris, and avoid becoming a tripping hazard. Furthermore, the brush portion 46 may cover, or substantially cover, the face of the cleaning device 40, the face being located proximate the second end 42, and facing away from the attachment device 30.

With continued reference to FIG. 5, there may be more than one method of operably attaching the cleaning device 40 to the attachment device 30. In one embodiment, the cleaning device 40 may slidably engage the mounting device 50. For instance, a method of slidably engaging a cleaning device 40 with a mounting device 50, or an attachment device 30, may include positioning the cleaning device 40 alongside the attachment device 30, aligning the mating surface 48 of the cleaning device 40 with the groove surface 38, and sliding the cleaning device 40 through the groove 37. For example, before a golfer starts a round of golf, the golfer may slide the cleaning device 40 into the attachment device 30, which is mounted on one of his or her shoes 90. Once the round is over, the golfer may remove the cleaning device 40 from the attachment device 30 and store it in his or her golf bag. Moreover, located somewhere on the cleaning device 40, or located somewhere on the base member 43, may be a dimple 44. The dimple 44 may be an indentation, detent, recession, crater, depression, and the like. An object, such as a golf tee, may engage the dimple 44, and help slide the cleaning device 40 along the groove 37 to facilitate the easy removal or attachment of the cleaning device 40 and from the attachment device 30.

Figure 6:
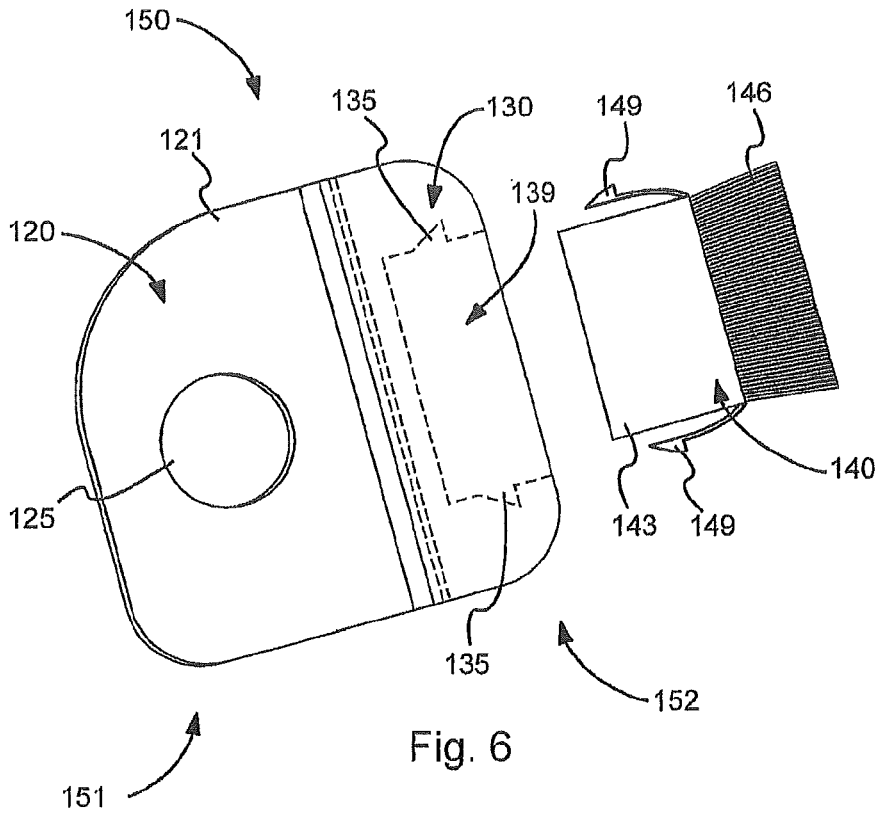
FIG. 6 depicts a perspective view of an embodiment of a mounting device and a cleaning device, in accordance with the present invention.
Figure 7:
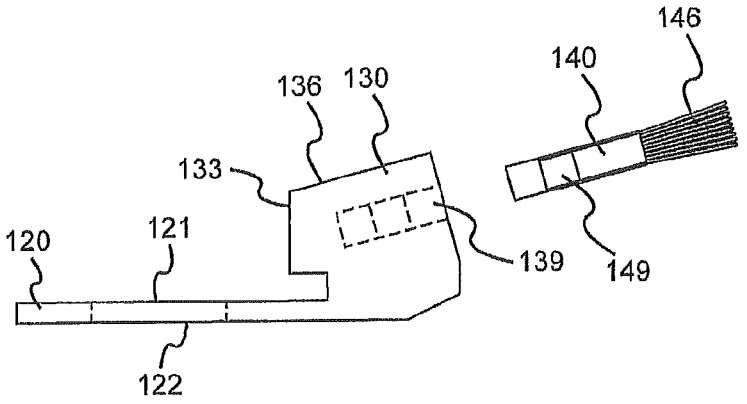
FIG. 7 depicts a side view of an embodiment of a mounting device and a cleaning device, in accordance with the present invention.

FIG. 6 and FIG. 7 depict another embodiment of a method of operably attaching the cleaning device 140 to the mounting device 150, or attachment device 130, which may include snapping or clipping the cleaning device 140, in particular, the base member 143, into a keyway 139. The keyway 139 may be similar to the groove 37, yet may not extend the entire horizontal distance of the attachment device 130 and may or may not be angled. A base member 143 may include at least one pressure release button 149 on its sides to removably secure the cleaning device 140 to the attachment device 140. The pressure release buttons 149 may be resilient, such that when depressed, they may return to their original position. The keyway 139 may include cut-outs 135 that correspond to the shape and volume of the pressure release buttons 149 located on the base member 143. Thus, the pressure release button 149 may be depressed, allowing the cleaning device 140 to enter the keyway 139. Once inside the keyway 139, the pressure release buttons 149 may spring back against the walls of the keyway 139, and may eventually fit within the cut-outs 135 to secure the cleaning device 140 into the attachment device 130. The cut-outs 135 may house, accommodate, contain, receive, accept, etc, the pressure release buttons 149. Those in the art will appreciate that other securing methods may be used, such as a hook, hook and fastener, ball and dimple, locking pins, detents, and other various securing methods which may removably secure the cleaning device 140 to the attachment device 130.

Figure 8:
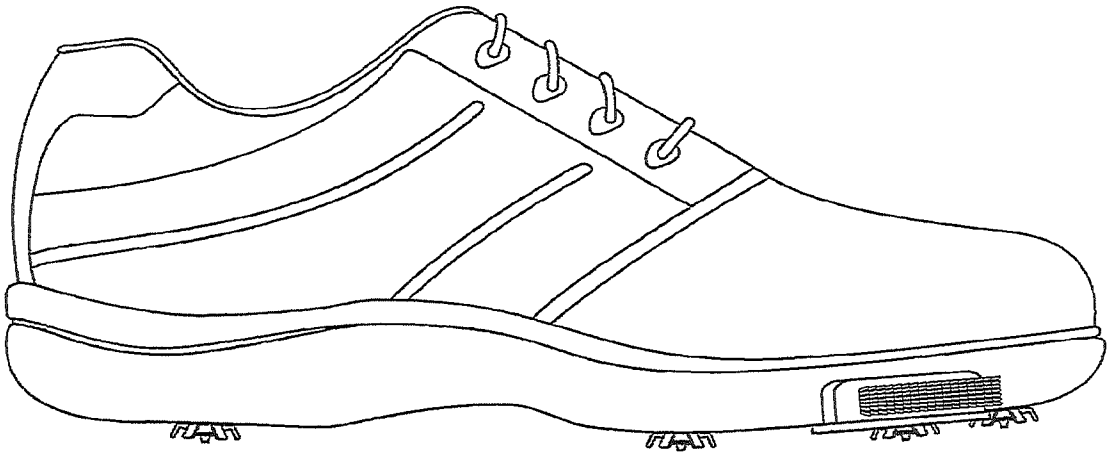
FIG. 8 depicts a perspective view of an embodiment of a brush portion attached to a side of a footwear, in accordance with the present invention.

Furthermore, the cleaning device 40, or simply a brush portion 46 may be coupled, bonded, attached, affixed, adhered, etc., to a footwear 90, or a portion of a footwear 90 directly, as shown in FIG. 8. For example, a brush portion 46 may simply directly engage a portion of a footwear, such as the side, edge, or outer surface 96 of a sole 95, without including the mounting device 50. The brush portion 46 may be glued, bonded, or adhered with a glue, cement, epoxy, or any other means to bond a brush portion 46 to a footwear 90.

Figure 9:
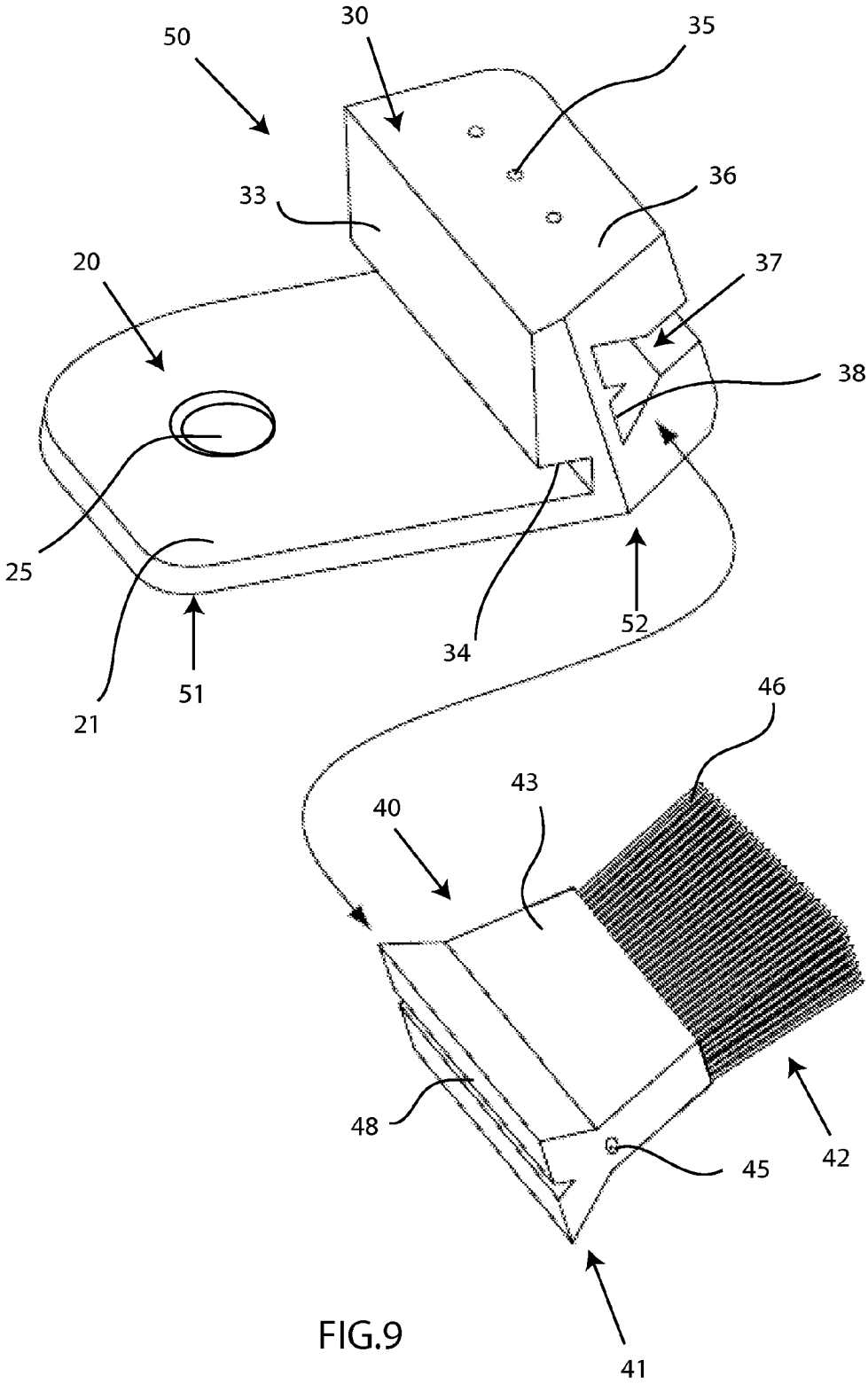
FIG. 9 depicts a perspective view of an embodiment of a method of slidably attaching a cleaning device to a mounting device, in accordance with the present invention.

With reference to FIGS. 1-9, in particular, FIG. 9, a method of cleaning a piece of sports equipment, such as a golf club, may include the steps of providing a cleaning device 40, wherein the cleaning device 40 has a first end 41 and a second end 42, coupling the first end 41 of the cleaning device 40 and an attachment device 30, wherein the attachment device 30 and a mounting plate 20 form a mounting device 50, wherein the mounting device 50 is configured to engage a footwear 90. A method may further include placing a layer of adhesive on a top surface 21 of the mounting plate 20 for securing the mounting plate 20 to a sole 95 of the footwear 90, securing the mounting plate 20 with at least one small fastener 85 and at least one large fastener 65, positioning at least one opening 25 on the mounting plate 20, and adjusting an angle of the cleaning device 30. Moreover, the method may further include molding the mounting plate 20 into a sole 95 of a footwear 90 to secure the mounting plate 20 to the sole 95 of a footwear 90. It should be understood that the device 100 may be also be an apparatus and method for cleaning more than just sports equipment. For example, the device 100 may be used to clean a piece of hardware, tools, such as a jack hammer or hammer drill, any work equipment, or any item that may appreciate hands-free cleaning.

Each component of device 100, including, but not limited to, mounting device 50, mounting plate 20, attachment device 30, groove 37, keyway 139, base member 43, flange 34, openings, 25, 35, 45, and dimple 44, may be fabrication and/or manufactured by the following methods: casting, extruding, cutting, knurling, turning, tapping, drilling, injection molding, blow molding, or other fabrication methods that may provide efficient production of the component.

Various modifications and variations of the described apparatus and method will be apparent to those skilled in the art without departing from the scope and spirit of the invention. Although this invention has been described in connection with specific embodiments, outlined above, it should be understood that the invention should not be unduly limited to such specific embodiments. Various changes may be made without departing from the spirit and scope of the invention.

What is claimed is:

1. A golf club cleaning device comprising:

a mounting plate configured to be coupled to a sole of a footwear, said mounting plate having at least one opening therethrough;

an attachment device on said mounting plate, said attachment device being receptive to a first end of a cleaning device to releasably secure said cleaning device to said mounting plate, wherein a first surface of said attachment device corresponds to a mating surface of said first end of said cleaning device; and a second end of the cleaning device configured to contact a golf club, said second end protruding from said footwear;

wherein at least one opening is located on said attachment device to removably secure the cleaning device;

wherein the sole of the footwear fits within a gap between the attachment device and the mounting plate, the gap created by a flange, further wherein the sole of the footwear physically contacts the mounting plate and the attachment device while positioned within the gap created by the flange.

2. The device of claim 1, further comprising:

an adhesive film applied to a top surface of said mounting plate, wherein said adhesive layer bonds said mounting plate to the sole of said footwear;

at least one small fastener securing said mounting plate to said sole of said footwear, wherein said at least one small fastener is driven through a bottom surface of said mounting plate; and at least one large fastener further securing said mounting plate to said sole of said footwear.

3. The device of claim 1, wherein the cleaning device includes a brush portion affixed to a base member, wherein said mating surface forms a bottom of said base member.

4. The device of claim 3, wherein a dimple is located on said base member of said cleaning device to assist removal of said cleaning device from said attachment device.

5. The device of claim 1, wherein the least one opening allows at least one locking pin to pass therethrough.

6. The device of claim 1, wherein said second end of said cleaning device includes a brush portion.

7. The device of claim 1, wherein said cleaning device angularly protrudes from said footwear.

8. A method of cleaning a golf club comprising:

providing a cleaning device, wherein said cleaning device has a first end and a second end;

removably securing the second end of the cleaning device to an attachment device, said attachment device and a mounting plate form a mounting device, wherein removably securing the second end of the cleaning device includes at least one of slidable engagement and snap engagement, further wherein at least one opening is located on said attachment device to removable secure the cleaning device;

attaching the mounting plate to a sole of a footwear, wherein the sole of the footwear fits within a gap between the attachment device and the mounting plate, the gap created by a flange, further wherein the sole of the footwear physically contacts the mounting plate and the attachment device while positioned within the gap created by the flange; and cleaning the golf club with the first end of the cleaning device.

9. The method of claim 8, further comprising:

placing a layer of adhesive on a top surface of said mounting plate for securing said mounting plate to the sole of said footwear;

securing said mounting plate with at least one small fastener and at least one large fastener; and positioning at least one opening on said mounting plate.

10. The method of claim 8, wherein the cleaning device slidably engages said attachment device.

11. The method of claim 8, wherein the cleaning device snaps into said attachment device.

* * * * *